United States Patent [19]

Schaefer

[11] Patent Number: 4,791,941

[45] Date of Patent: Dec. 20, 1988

[54] ATHLETIC MOUTH GUARD

[75] Inventor: Quinton A. Schaefer, Strongsville, Ohio

[73] Assignee: Gator Corporation, Strongsville, Ohio

[21] Appl. No.: 61,086

[22] Filed: Jun. 12, 1987

[51] Int. Cl.[4] ..... A61F 5/56

[52] U.S. Cl. ..... 128/861

[58] Field of Search ..... 128/136, 776, 777; 24/182, 136, 231

[56] References Cited

U.S. PATENT DOCUMENTS

| | | | |
|---|---|---|---|
| 11,488 | 4/1896 | Bringham | 24/182 |
| 420,871 | 2/1890 | Fischer | 24/182 |
| 532,864 | 1/1895 | Brittain | 24/231 |
| 1,146,264 | 7/1915 | Kelly | 128/136 |
| 2,192,558 | 3/1940 | Poindexter | 128/136 |
| 2,521,039 | 9/1950 | Carpenter | 128/136 |
| 2,590,118 | 3/1952 | Oddo, Jr. | 128/136 |
| 2,966,908 | 1/1961 | Cathcart et al. | 128/136 |
| 3,407,809 | 10/1968 | Ross | 128/136 |
| 3,448,738 | 6/1969 | Berghash | 128/136 |

*Primary Examiner*—Robert A. Hafer
*Assistant Examiner*—Charles H. Sam
*Attorney, Agent, or Firm*—J. Helen Slough

[57] ABSTRACT

An athletic mouth guard useful in contact sports for protecting an athlete's teeth comprising a U-shaped double trough mouth piece secured to a connecting strap adapted to be attached to the face guard on a helmet. The distal end of the connecting strap contains an oblong opening whereby a looped connection can be made with a bar on the face guard by passing the mouth piece through the oblong opening and pulling the loop into tight engagement with the bar on the face guard.

2 Claims, 2 Drawing Sheets

ATHLETIC MOUTH GUARD

BACKGROUND OF THE INVENTION

This invention pertains to mouth guards used by athletes in contact sports and particularly to a mouth guard adapted to comfortably protect both the upper and lower teeth of the athlete. The mouth guard includes a connecting strap for expedient attachment or detachment to a helmet face guard.

Plastic or rubber athletic mouth gards are known. For instance, mouth guards adapted to guard the upper teeth are disclosed in the following U.S. Pat. Nos.: 3,250,272; 3,211,143; 2,630,117; 3,224,441; 3,124,129; 3,096,761; and 3,112,744. Other patents disclose mouth guards for protecting the upper teeth where the mouth guards are interconnected to an elongated tie or strap member adapted to be attached to the face guard or chin strap of a football helmet such as shown in U.S. Pat Nos. 3,312,218; 3,411,501; and 3,485,242. In these patents, the mouth guards are formed of rigid thermoplastic material which is required to be heat formed to conform to the athlete's upper teeth configuration. Similarly U.S. Pat No. 3,314,423 and U.S. Pat No. 3,448,738 disclose protective mouth guards for upper teeth where the connecting straps provide a snap-on connection comprising a molded enlargement or button adapted to interlock with a button hole in the strap to provide means for connecting the strap to the helmet or to the mouth guard. The snap-on connections, however, are fragile and are easily unsnapped upon impact. U.S. Pat No. 2,847,003 discloses an upper tooth guard having a similar snap-on connection with a strap secured to a helmet chin strap. Disclosed in U.S. Pat. No. 2,521,039 is a full mouth guard comprising an enlarged upper tooth guard and a lower tooth guard adapted to cover both the upper and lower teeth as well as the adjacent gums. The reference mouth guard is provided with breathing channels disposed between the vertically spaced apart upper and lower guards to enable the athlete to breathe. However, the mouth guard is abnormally bulky and cumbersome in addition to being inherently dangerous. Continuous gripping by the athlete's spaced apart jaws endangers the athlete to jaw injuries and dislocations due to sudden impacts against the jaws vertically spread apart by the reference mouth guard. The enlarged lower tooth guard further irritates the athlete's lower gums and further contributes to the discomfort and endangerment to jaw injuries while in use.

It now has been found that these and other dangers and discomforts can be avoided by a mouth guard made of molded resilient rubber and adapted to protect both the upper and lower teeth and further maintain locking engagement of the jaws to prevent lateral movement of the lateral jaw. The mouth guard of this invention can be safely used without difficult breathing problems by attaching the mouth guard to a flexible connecting strap adapted to be easily attached or detached to a helmet face guard but remain well secured thereto during use. The resilient rubber molded mouth guard is much more durable than rigid thermoplastic mouth guards which are susceptible to chewing and destruction. The resilient rubber flanges can be easily trimmed if necessary to fit the athlete's teeth but does not require heat to conform the mouth guard. Hence the resilient rubber composition provides a comfortable fit and full protection to the teeth. The integral upper and lower guards interconnected by a narrow web adapted to engage the gripping upper and lower teeth maintains the natural tight locking engagement between the upper and lower jaw which further prevents lateral movement of the lower jaw and jaw injuries. The connecting strap contains a looping arrangement at the distal end wherein an oblong opening permits looping the strap around a bar on the face mask and passing the mouth guard through the oblong opening to provide a tight and secure attachment of the mouth piece to a helmet. These and other advantages will become more apparent by referring to drawings and detailed description of the invention.

SUMMARY OF THE INVENTION

Briefly, the mouth guard of this invention comprises a U-shaped double trough mouth piece attached to an elongated connecting strap adapted to be attached to a helmet face guard. The double trough mouth piece comprises a deep resilient upper trough and a shallow relatively rigid lower trough adapted to protect the upper teeth and lower teeth simultaneously while preventing lateral movement of the lower jaw in use. The mouth guard is integrally interconnected to the connecting strap which includes an open loop configuration having an oblong opening in the distal loop. The open loop provides a looping means attachment to the helmet face guard by passing the strap around a bar of the face guard and passing the mouth guard through the loop opening and pulling the loop tight against the bar.

IN THE DRAWINGS

DETAILED DESCRIPTION OF THE INVENTION

Figure 1:
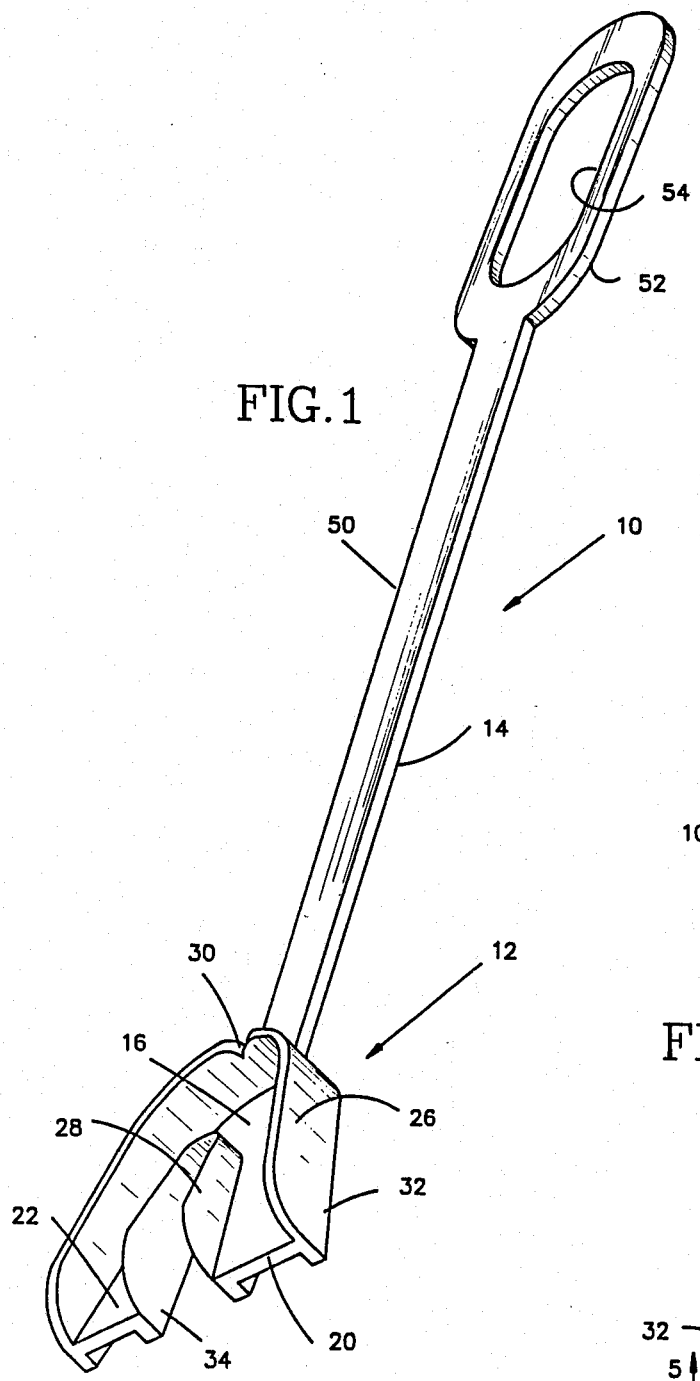
FIG. 1 is a perspective plan view of the athletic mouth guard of this invention.

Referring now to the drawings wherein like characters designate like parts, shown generally is an athletic mouth guard 10 comprising a U-shaped double trough mouth piece 12 integrally molded to an elongated flat strap 14 adapted to be attached to a helmet face guard.

The double trough mouth piece 12 comprises a relatively deep upper trough 16 and a rather shallow depth lower trough 18 integrally interconnected by an intervening flat web 20. The flat web 20 provides an upper flat base surface 22 and a lower flat base surface 24 adapted to engage the upper teeth and lower teeth respectively in use. The upper trough 16 is defined by an outer peripheral thin wall member or flange 26 and a laterally spaced smaller inner peripheral thin wall member or flange 28 in conjunction with the interconnecting lower base 22, as best viewed in FIG. 1. The outer peripheral wall member 26 is relatively large in height and adapted to cover the buccal side of the upper teeth as well as part of the upper gums. The outer peripheral wall 26 further includes an indent 30 located midway of the circular intermediate section 36 opposite the open end 38 of the U-shaped mouth piece where the indent 30 accomodates tissues on the front buccal side of the upper jaw. The inner peripheral wall 28 is relatively smaller in height and adapted to cover and protect the lingual side of the upper teeth. Both the outer peripheral wall member 26 and inner peripheral wall member 28 are resilient and preferably rather flexible to provide a conforming comfortable fit with the upper teeth.

Figure 2:
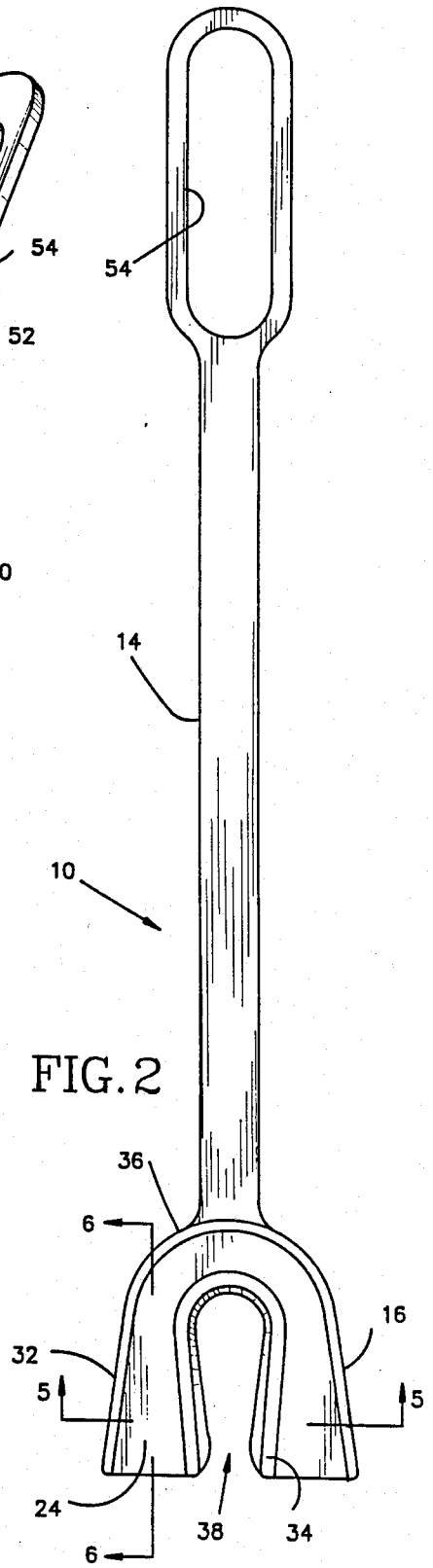
FIG. 2 is a bottom view of the mouth guard shown in FIG. 1.
Figure 5:
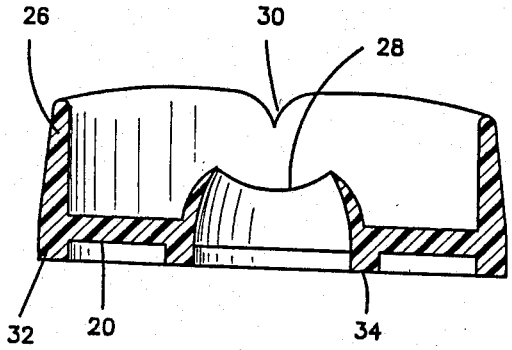
FIG. 5 is a sectional elevation view taken along lines 5—5 in FIG. 2.
Figure 6:
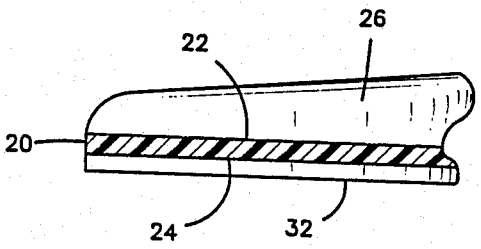
FIG. 6 is a sectional elevation view taken along lines 6—6 in FIG. 2.

In contrast, the lower trough 18 of the mouth piece 12 is shallow in depth and defined by an outer peripheral rib 32 laterally spaced from an inner peripheral rib 34 in conjunction with the intervening lower base 24 as best viewed in FIG. 2. The ribs 32 and 34 are blunt and rather rigid to maintain close contact with the lower teeth in use. The rigid ribs 32 and 34 preferably are approximately square in cross section, as best viewed in FIG. 5, where the width and depth of the ribs 32 and 34 are considerably less than the width of the lower trough 18. For example, the ribs 32 and 34 could be about one-eighth inch square relative to a lower trough width of one fourth inch at the narrowest point. As best viewed in FIG. 2, the lower trough width contracts from the open end 38 of the mouth piece to the closed circular end 36 of the mouth piece. For example, the open end 38 width of the lower trough advantageously can be about three-eighths inch which progressively contracts to about one-fourth inch width trough at the closed end 36 of the mouth piece 12. The rigid outer peripheral rib 32 and the rigid inner peripheral rib 34 of the lower trough 18 are particularly adapted to maintain rigid engagement with the lower teeth during impact and thereby effectively prevent lateral movement of the lower jaw during impact.

Figure 3:
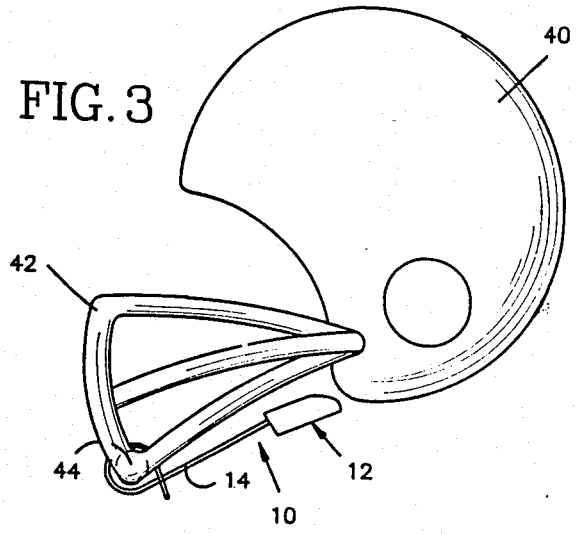
FIG. 3 is a side elevation view of the mouth guard attached to a helmet face guard.
Figure 4:
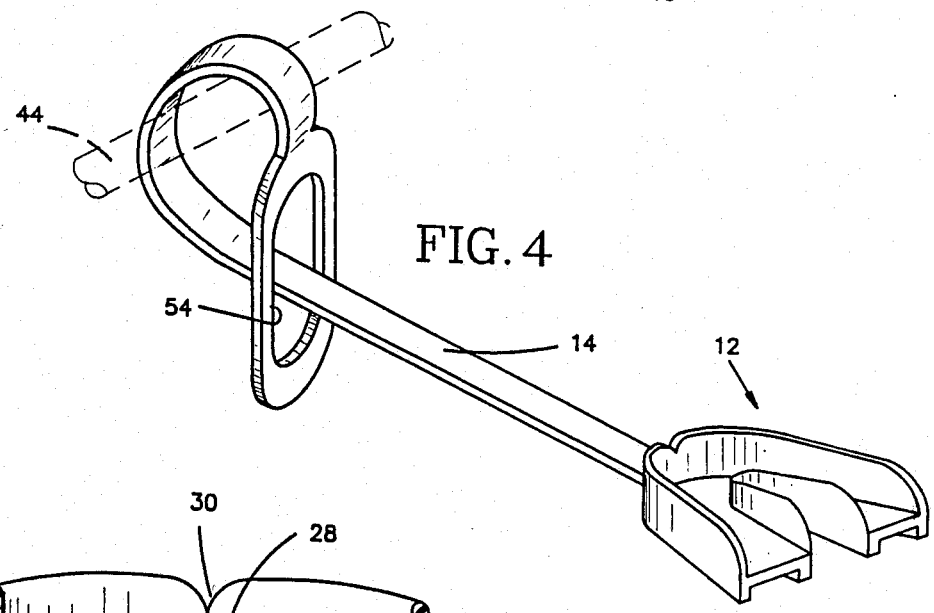
FIG. 4 is an enlarged perspective view of the mouth guard attached to a bar removed from the face guard shown in FIG. 3.

The mouth piece 12 attached to the elongated connecting strap 14 is adapted to be attached to a helmet 40 having a face guard 42 containing a cross bar 44 as viewed in FIG. 3 and FIG. 4. The strap 14 comprises a flat elongated stem 50 terminating in an open loop 52 containing an oblong shaped internal opening 54. The oblong opening 54 is preferably aligned in the elongated direction of strap 50 and provides an expedient means for attachment or detachment of the strap 50 to the helmet cross bar 44 by looping the stem 50 around the bar 44 and passing the mouth piece 12 through the oblong opening 54 and pulling the open loop end 52 in tight engagement with the bar 44, as best viewed in FIG. 4. It is readily seen that the mouth piece 12 can be flexed or twisted sideways, and squeezed together if necessary, in order to pass the open end 38 of the mouth piece 12 through the oblong opening 54. Attached to the helmet accordingly, the mouth guard 10 of this invention provides secure attachment to the helmet 40 during games but can be easily attached and detached for cleaning or replacement purposes.

In use, the mouth guard 10 can be readily attached to the helmet 40 by looping the stem 50 around a face mask bar 44 and passing the mouth piece 12 through the oblong opening 54 as previously described. The mouth piece 12 can be placed in the player's mouth and held between the upper and lower teeth during play but quickly released from the mouth upon conclusion of a play without concern of losing the mouth guard 10. The permanent attachment avoids undesirable loss of the mouth piece during heavy contact or impact. The double trough construction of the mouth piece 12 protects the upper teeth and gums along with the lower teeth and particularly prevents undesirable lateral movement of the lower jaw upon impact. The resilient upper trough 16 is sufficiently resilient to comfortably protect the upper teeth whereas the relatively shallow and rigid construction of the lower trough 18 effectively protects the lower teeth but especially prevents lateral movement of the lower jaw.

The foregoing drawings and detailed description disclose preferred embodiments of the invention but are not intended to be limiting except by the appended claims.

What I claim is:

1. A method of attaching a mouth guard to a bar of a face guard for a helmet, where the mouth guard is adapted to protect the upper and lower teeth of an athlete, the method of attaching comprising:

providing a U-shaped mouth guard having an upper portion adapted to surround the upper teeth between outer and inner thin peripheral walls and having a lower portion with relatively inner and outer thick peripheral walls surrounding the lower teeth, said guard connected to an elongated connecting strap having a free end having an oblong opening;

looping the free end of the strap over the bar of the face guard and passing the mouth guard bar through the oblong opening to provide a secure connection of the mouth guard to the bar.

2. The mouth guard in claim 1 wherein the oblong opening is in alignment with the elongated dimension of the connecting strap.

* * * * *